US007121809B2

(12) United States Patent
Takagi et al.

(10) Patent No.: US 7,121,809 B2
(45) Date of Patent: Oct. 17, 2006

(54) METHOD OF DRIVING PUMP

(75) Inventors: Kunihiko Takagi, Okaya (JP); Takeshi Seto, Chofu (JP); Kazuhiro Yoshida, Yamato (JP)

(73) Assignee: Seiko Epson Corporation, (JP)

( * ) Notice: Subject to any disclaimer, the term of this patent is extended or adjusted under 35 U.S.C. 154(b) by 103 days.

(21) Appl. No.: 10/972,974

(22) Filed: Oct. 22, 2004

(65) Prior Publication Data

US 2005/0147502 A1 Jul. 7, 2005

(30) Foreign Application Priority Data

Oct. 24, 2003 (JP) ..... 2003-364739

(51) Int. Cl.
*F04B 17/00* (2006.01)

(52) U.S. Cl. ..... 417/53; 417/413.2; 417/557

(58) Field of Classification Search ..... 417/44.2, 417/413.1, 413.2, 557, 53
See application file for complete search history.

(56) References Cited

U.S. PATENT DOCUMENTS 6,623,256 B1 * 9/2003 Takagi et al. ..... 417/413.2
7,011,507 B1 * 3/2006 Seto et al. ..... 417/413.2
2003/0215342 A1 * 11/2003 Higashino et al. ..... 417/413.2
2004/0013539 A1 * 1/2004 Takagi et al. ..... 417/413.2
2004/0018100 A1 * 1/2004 Takagi et al. ..... 417/413.2

OTHER PUBLICATIONS

Yoshida et al, "Simulation of Micropump Using Inertia Effect of Fluid" (Japanese original document, 2 pages and English translation, 3 pages).

* cited by examiner

*Primary Examiner*—Michael Koczo, Jr.
(74) *Attorney, Agent, or Firm*—Harness, Dickey & Pierce, P.L.C.

(57) ABSTRACT

A pump is provided having a pump chamber that is capable of changing a volume thereof by a diaphragm, an inlet passage permitting an operating fluid to flow into the pump chamber; an outlet passage permitting an operating fluid to flow out from the pump chamber; and a check valve provided on the inlet passage. An inertance value of the inlet passage is smaller than the inertance value of the outlet passage. The diaphragm is driven by a frequency f (Hz) satisfying the following formula:

$$f \geq \frac{0.26}{X\sqrt{LS}}$$

wherein the inertance value of the outlet passage is L (kg/m$^4$), the displacement from an upper end point to a bottom end point of the diaphragm is X (m), and the cross section area of the pump chamber is S (m$^2$).

4 Claims, 4 Drawing Sheets

A CASE OF A PUMP CHAMBER WITH A 9mm DIAMETER

METHOD OF DRIVING PUMP

RELATED APPLICATIONS

This application claims priority to Japanese Patent Application No. 2003-364739 filed Oct. 24, 2003 which is hereby expressly incorporated by reference herein in its entirety.

BACKGROUND

1. Technical Field

The present invention relates to a small-sized pump that moves a liquid by changing a volume inside a pump chamber through a piston or a diaphragm and the like.

2. Related Art

There has been proposed a high output pump having a piston or a diaphragm driven by a piezoelectric element such as a PZT, a pump chamber capable of changing the volume by the diaphragm or the piston, an inlet passage to permit an operating fluid to flow into the pump chamber; an outlet passage to permit the operating fluid to flow out of the pump chamber; and a fluid resistance element such as a check valve provided on the inlet passage and the outlet passage. In this pump, an inertance value of the inlet passage is smaller than the inertance value of the outlet passage and the amount of outlet fluid is large corresponding to a high load pressure (Refer to Japanese Unexamined Patent Application Publication No. 2002-62986).

In the pump disclosed in Publication No. 2002-62986, the output is increased by the inertia effect of a fluid having a large inertance at the outlet passage. There is a problem in that the change of the inertia effect caused by the change of a driving waveform of a piston or a diaphragm or a pump size affects the output seriously.

Therefore, the present invention is intended to provide a method of driving a high output pump by using the inertia effect.

SUMMARY

A method of driving a pump is provided. The pump includes a pump chamber capable of changing a volume thereof by a movable wall such as a piston or a diaphragm; an inlet passage to permit an operating fluid to flow into the pump chamber; an outlet passage to permit the operating fluid to flow out of the pump chamber; and a fluid resistance element provided on the inlet passage and the outlet passage. The method comprising:

making an inertance value of the inlet passage be smaller than the inertance value of the outlet passage, and driving the movable wall with a frequency f (Hz) satisfying the following formula;

$$f \geq \frac{0.26}{X\sqrt{LS}}$$

wherein the inertance value of the outlet passage is L(kg/m$^4$), the displacement from an upper end point to a bottom end point of the movable wall is X(m), and the cross section area of the pump chamber is S (m$^2$).

According to the invention, a high pumping output can be attained regardless of pump size by increasing an output by using an inertia effect of a fluid caused by the large inertance at an outlet passage.

Further, in the method of driving a pump of the present invention, it is preferable to drive the movable wall with a frequency f (Hz) satisfying the following formula:

$$f \geq \frac{0.4}{X\sqrt{LS}}$$

According to the invention, a pumping output with a double multiplied wave mode described later can be attained regardless of pump size. If it is driven by a double multiplied wave mode, the endurance of a check valve is improved so as to enhance the reliability of a pump.

Further, when the movable wall is driven with a frequency f (Hz) satisfying the following formula:

$$f \leq \frac{0.85}{X\sqrt{LS}}$$

a high pumping output with a double multiplied wave mode can be certainly attainted.

In addition, the driving waveform of a piston or a diaphragm is preferably an approximate sine wave. According to the invention, it is easy to attain a driving circuit with an internal stress generated in an actuator while driving can be small so as to enhance the reliability of an actuator and a pump.

DETAILED DESCRIPTION

Embodiments of the invention will now be described with reference to the accompanying drawings.

Figure 1:
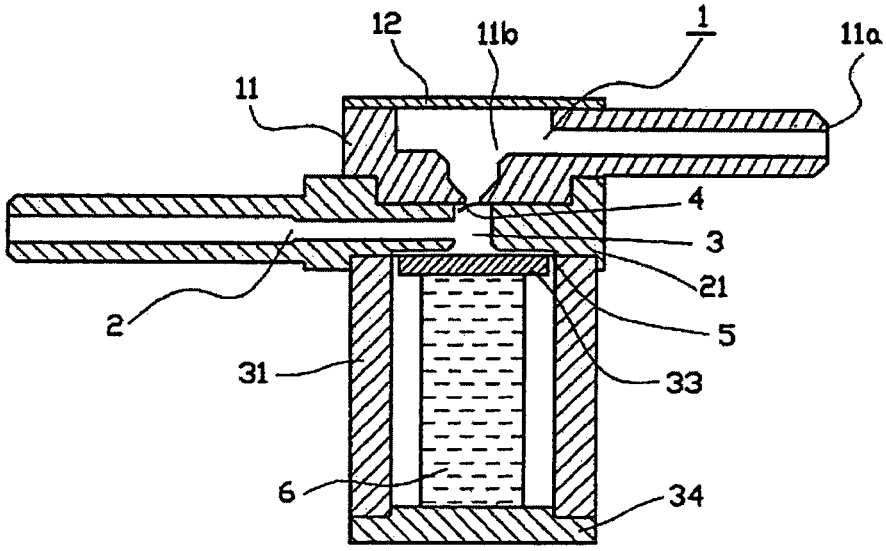
FIG. 1 shows a longitudinal cross section of a pump according to the present invention.

FIG. 1 shows a longitudinal cross section of a pump according to an embodiment of the present invention. A case bottom plate 34 is rigidly fixed by welding at the bottom of a piezoelectric element case 31, which is a member for supporting a multi layered type piezoelectric element 6. On the upper surface of the multi layered type piezoelectric element 6 as a driving source for a pump, an end plate 33 is adhered in advance so as to form a multi layered type piezoelectric element unit which is fixed within the piezoelectric element case 31. The fixing is preformed by adhering the bottom surface of the multi layered type piezoelectric element 6 with the case bottom plate 34.

After fixing the case bottom plate 34, the upper surface of the piezoelectric element case 31 is treated to be co-planar with the upper surface of the end plate 33 by a polishing process. A diaphragm 5 is adhered to both the end plate 33 and the piezoelectric element case 31 which are rendered co-planar by polishing process.

The diaphragm 5 is composed of a stainless steel thin plate about 20 μm thick and a pump chamber member 21 is installed so as to sandwich the diaphragm 5 with the piezoelectric element case 31.

A pump chamber 3 and an outlet passage 2 are formed inside the pump chamber member 21. The pump chamber member 21 is fixed with the piezoelectric element case 31 with a fastener such as a screw not shown in the figure. An inlet passage member 11 is engaged in the upper portion of the pump chamber member 21 and fixed with a fastener such as a screw not shown in the figure.

The open surface of the inlet passage member 11 is sealed with a pressure-variation absorbing plate 12, which is flexible with a high barrier against gas. The material for the pressure-variation absorbing plate 12 is preferably a complex material of a metal thin film with a resin so that flexibility is compatible with a barrier property against a gas.

A passage within a pump of the present invention will now be described. A liquid input from an outer pipe not shown in the figure and installed at the upstream of a connection 11*a* flows into the pump chamber 3 from the pressure-variation absorbing cavity 11*b*. The passage to the pump chamber 3 of the pressure-variation absorbing cavity 11*b* is gradually shrunk to be a hole having about a 0.5 mm diameter and connected to the pump chamber 3. A lead type check valve 4 composed of a 15 μm stainless steel thin plate is installed as a fluid resistance element at the interface between the pressure-variation absorbing cavity 11*b* and the pump chamber 3 so as to avoid back flow from the pump chamber 3 to the pressure-variation absorbing cavity 11*b*. An inlet passage 1 comprises a passage from the connection 11*a* to the outer pipe to the check valve 4.

The pump chamber 3 comprises the connection, in which the outlet passage 2 is opened, and a compressed portion with a flat shape at the upper portion of the diaphragm 5. A fluid from the pump chamber 3 flows through the outlet passage 2 and is output to an outer pipe not shown in the figure. Here, an outer pipe not shown in the figure and installed upstream from the inlet passage 1 and an outer pipe not shown in the figure and installed at the protruded portion of the pump chamber member 21, in which the outlet passage 2 is formed, are preferably composed of a resin tube with appropriate flexibility.

Next, an inertance L of a passage is defined. The inertance L is given as $L=\rho xl/S_f$ when the cross section of a passage is $S_f$, the length of a passage is 1 and the density of operating fluid is ρ. Further, the relationship $\Delta P=LxdQ/dt$ is introduced by using the inertance L, when the different pressure is ΔP and the amount of liquid flowing through a passage is Q. Namely, the inertance L represents the degree of affect of a unit pressure to an amount change of fluid per unit time. The larger the inertance L is, the smaller the amount change of fluid per unit time is. The smaller the inertance L is, the larger the amount change of fluid per unit time is.

A method of integrating inertances relating to a parallel connection of a plural passages or a series connection of a plural passages having different configurations can be calculated as a way that the inertance for an individual passage is integrated with other similar to a parallel connection or series connection of inductance in an electric circuit. In detail, the inertance when connecting plural passages in parallel can be obtained via integration similar to a parallel connection of inductances. In detail, the inertance when connecting plural passages in series can be obtained via integration similar to a series connection of inductances.

Further, it should be considered that the inertance includes a pressure-variation absorbing element when a pressure-variation absorbing element such as flexible member exists in a passage.

Therefore, the inertance of the inlet passage is the inertance from the pressure-variation absorbing plate 12 as the pressure-variation absorbing element to the lead valve 4 in a pump of the invention. On the other hand, the inertance of the outlet passage is the inertance of the outlet passage 2. The inertance of the outlet passage is far larger than that of the inlet passage since the length of the outlet passage is longer than that of the inlet passage and the former cross section is smaller than the latter.

Figure 2:
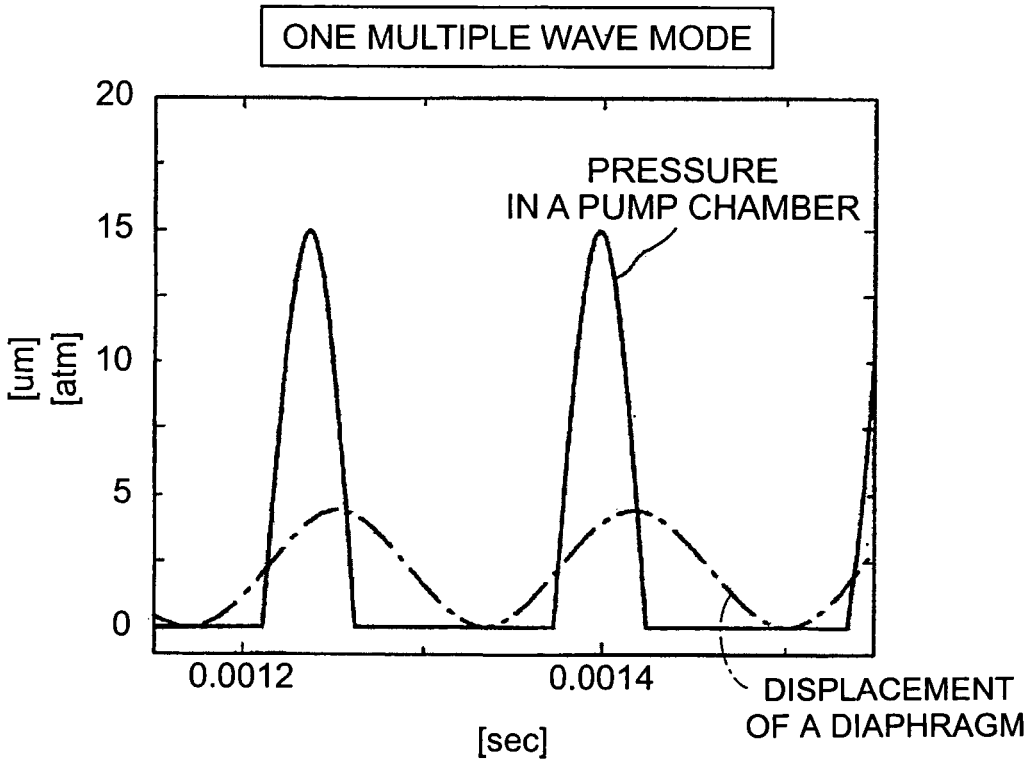
FIG. 2 is a graph showing the internal state of the pump with a one multiple mode wave according to the embodiment of the present invention.

Next, a pumping operation is explained referring to FIG. 2 showing an inside state at the time of operating a pump of the present embodiment when an operating liquid is water.

FIG. 2 shows a graph indicating a change of waveform of the diaphragm 5 driven by the multi layered piezoelectric element 6 and a pressure waveform as an absolute waveform inside of the pump chamber 3. In this case, a sine wave voltage having a frequency of 5.5 KHz is applied to the multi layered piezoelectric element 6 and synchronized with displacement of the diaphragm 5. The displacement of the diaphragm 5 increases toward the upward direction as shown in FIG. 1 so as to press or decrease the volume of the pump chamber 3. As seen in FIG. 2, pressure starts to increase due to the pressing of the pump chamber 3 at a little displacement which is far from the bottom of a displacement. After passing the maximum displacement gradient point, internal pressure in the pump chamber 3 is suddenly decreased. When coming close to absolute zero pressure, a component dissolved in the operating liquid is vaporized to be air bubbles so as to cause aeration or cavitations, and then it becomes flat around absolute zero pressure.

In detail, firstly, under the state of closing the check valve 4, when the volume of the pump chamber 3 is pressed, pressure inside the pump chamber 3 is largely increased by a large inertance of an operating liquid inside of the inlet passage 2. By this pressure increase, an operating liquid within the outlet passage 2 is accelerated so as to store kinetic energy. When the gradient of the expansion and contraction speed of the multi layered piezoelectric element 6 becomes small, an operating liquid continues to flow with the inertia effect caused by the kinetic energy stored in an operating liquid within the outlet passage 2 so as to suddenly decrease pressure in the pump chamber 3 and make the pressure smaller than a pressure within the inlet passage 1. At this time, the check valve 4 is opened by the pressure difference so as to make an operating liquid flow from the inlet passage 1 into the pump chamber 3.

At this time, the inertance of the inlet passage is smaller than that of the outlet passage 2 so as to make the increase ratio of the amount of liquid flowing from the inlet passage large. Therefore, at the same time when an operating liquid continues to flow from the outlet passage 2, it also flows into the pump chamber 3. Then, under the state when flowing in and flowing out arise simultaneously at the pump chamber 3, the multi layered piezoelectric element 6 is contracted continuously until the time when it is expanded. This is the situation of the plain portion of the inner pressure of the pump chamber shown in FIG. 2. Thus, since flowing in and flowing out arise simultaneously in the pump of this embodiment, it can make a large amount of liquid flow and handle a high load pressure because of extreme high pressure in the pump chamber.

Figure 3:
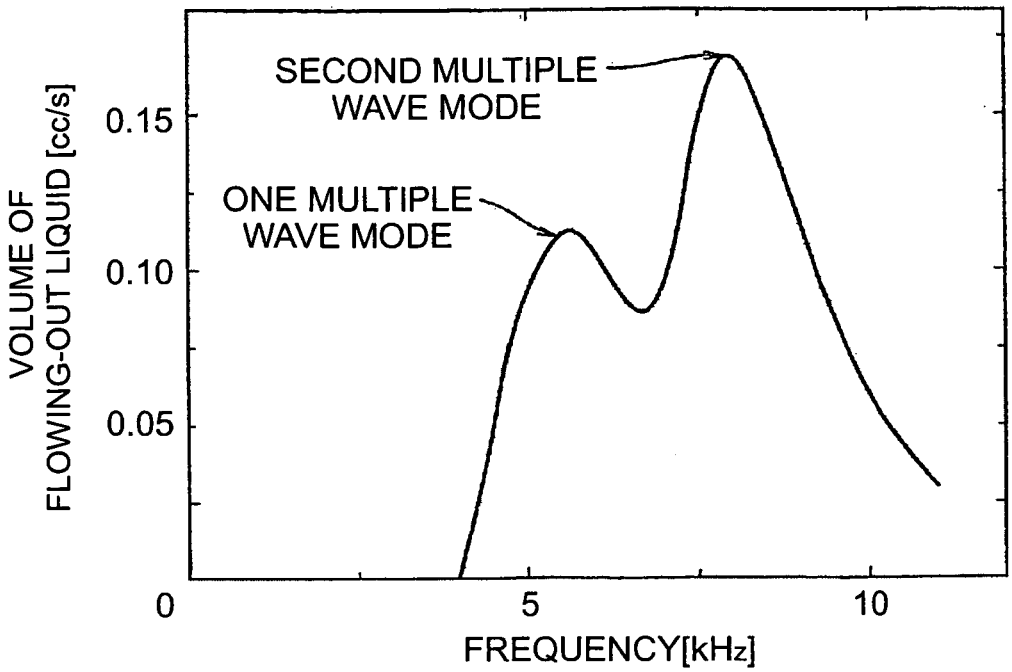
FIG. 3 is a graph showing the change of the volume of the flowing out fluid corresponding to the driving frequency of the diaphragm.

Here, when driving the diaphragm 5 of the embodiment with a sine curve wave, a volume of flowing-out fluid changes in response to a driving frequency as shown in FIG. 3 and represents two peaks having a large amount of volume of the flowing-out liquid. The internal state of the pump at the first peak with a low driving frequency is shown in FIG. 2 and is a driving state where a period of the displacement of the diaphragm is equivalent to a period of the pressure within the pump chamber called a one multiple wave mode.

Figure 4:
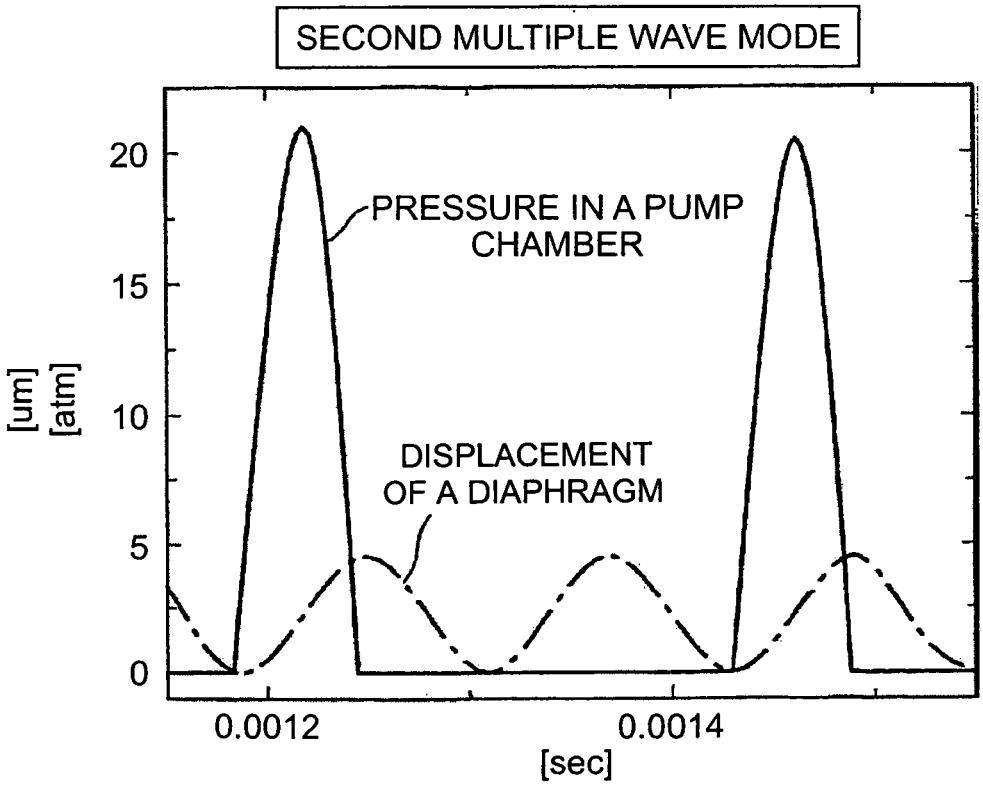
FIG. 4 is a graph showing the internal state of the pump with a double multiple mode wave according to the embodiment of the present invention.

The internal state of the pump at the second peak with a high driving frequency is explained referring to FIG. 4. FIG. 4 also shows waveforms of the internal pressure of the pump chamber 3 and the displacement of the diaphragm. Further, in FIG. 4, there is a state where a period of the internal pressure change of the pump chamber is doubled as compared to a period of the displacement of the diaphragm called a double multiplied wave mode. In this double multiplied wave mode, since a frequency is high even during a constant amplitude of the displacement of the diaphragm 5, a volume of the pump chamber 3 is rapidly decreased and the maximum value of the internal pressure of the pump chamber becomes large as compared to that of a one multiple wave mode. As a result, a fluid speed within the outlet passage 2 becomes fast as compared to that of the one multiple wave mode and flowing-out continues over a longer time. Thus, a driving period of the diaphragm 5 is considered to be the double multiplied wave mode with the state of opening the absorbing valve, after a period of raising the internal pressure of the pump chamber.

FIG. 3 shows the case when a volume of the flowing-out liquid at the time of the double multiplied wave mode is larger as compared to that at the time of the one multiple wave mode. But, depending on conditions, the reverse may also take place.

As described above, the pump of the present embodiment utilizes the inertia effect of a liquid within the outlet passage 2 so as to increase the pumping output depending on a driving waveform of the multi-layered piezoelectric element 6 and changes the pumping output depending on the size of portions within the pump. On the other hand, a method of driving a pump with a high output has never been fully explained conventionally.

Therefore, the inventor made a great effort with repeating experiments and research so as to find the relationship of a driving frequency with a pump dimension, which can attain high pumping output when driving the diaphragm 5 with a sine wave curve. The relationship will now be described as follows.

Figure 5:
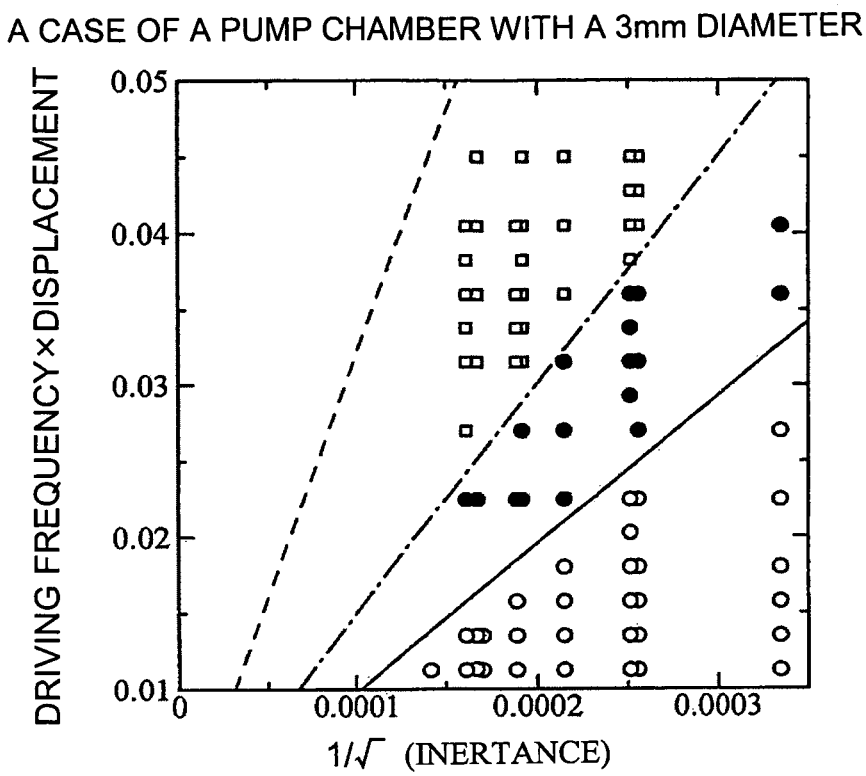
FIG. 5 is a graph showing the maximum output of the pump of the embodiment at each parameter, where these parameters are the inertance of the outlet passage and the driving frequency under the diameter of the pump chamber 3 mm.

FIG. 5 shows the result of searching the maximum output of the pump for each parameter value, when these parameters are the inertance of the outlet passage 2 and the driving frequency of the piezoelectric element 6 with the diameter of the pump chamber equal to 3 mm. The horizontal axis shows the inverse number of the square root of the outlet passage 2. The vertical axis shows the product of the driving frequency of the diaphragm 5 with the displacement of the diaphragm 5 from the bottom end point to top end point. Here, a white round mark represents the region of output under 100 mW with a one multiple mode, a black round mark represents the region of output greater than or equal to 100 mW with a one multiple mode, and a square white mark represents the region of output greater than or equal to 150 mW with a double multiple (multiplied) mode.

Figure 6:
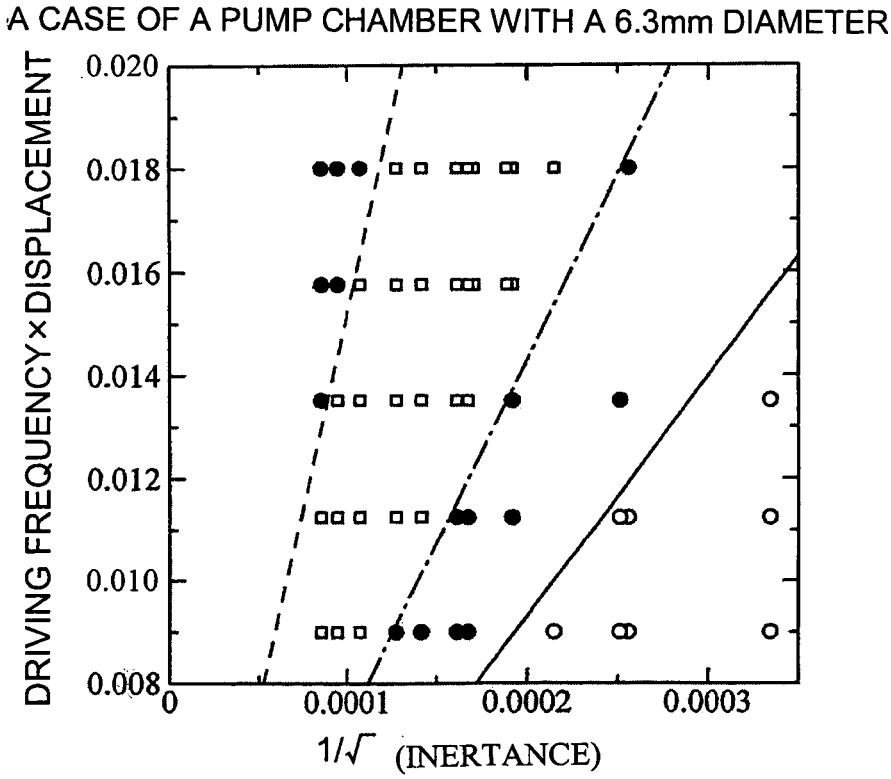
FIG. 6 is a graph showing the maximum output of the pump of the embodiment at each parameter, where these parameters are the inertance of the outlet passage and the driving frequency under the diameter of the pump chamber 6.3 mm.

FIG. 6 shows the result of searching the maximum output of the pump for each parameter value, when these parameters are the inertance of the outlet passage 2 and the driving frequency of the piezoelectric element 6 with the diameter of the pump chamber equal to 6.3 mm. The coordinate axis and marks are the same in FIG. 5.

Figure 7:
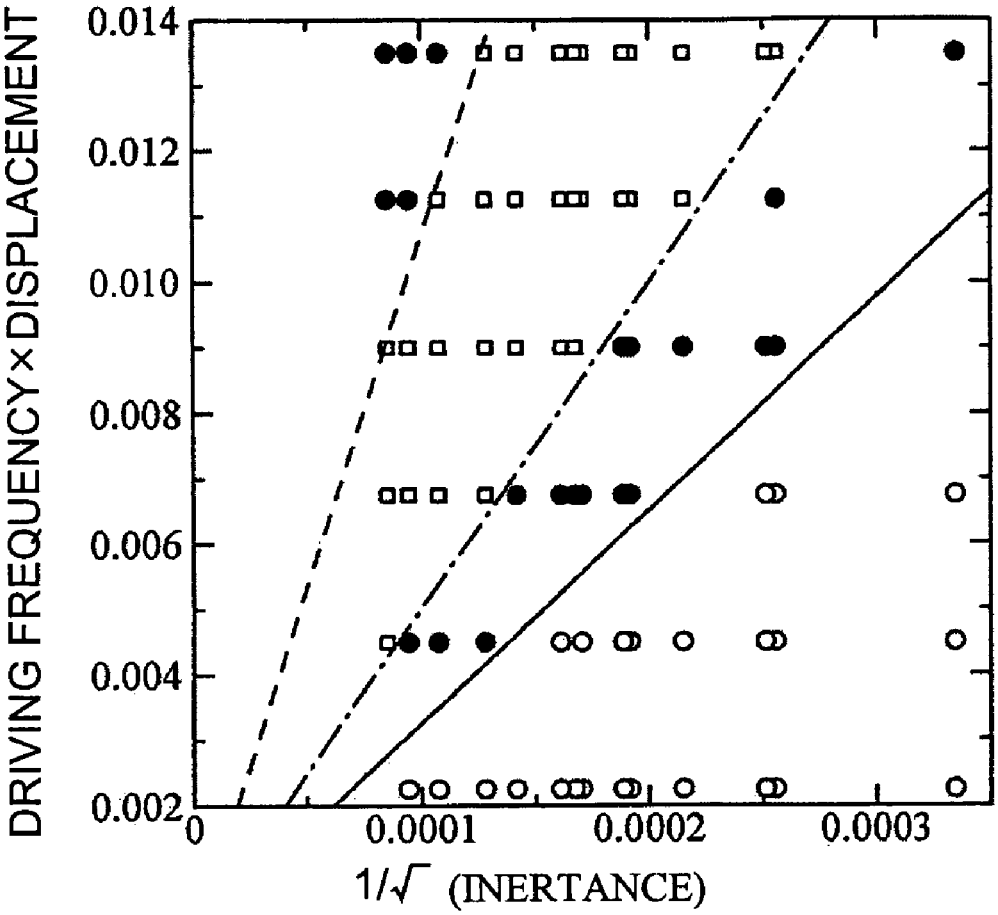
FIG. 7 is a graph showing the maximum output of the pump of the embodiment at each parameter, where these parameters are the inertance of the outlet passage and the driving frequency under the diameter of the pump chamber 9 mm.

FIG. 7 shows the result of searching the maximum output of the pump for each parameter value, when these parameters are the inertance of the outlet passage 2 and the driving frequency of the piezoelectric element 6 with the diameter of the pump chamber equal to 9 mm. The coordinate axis and marks are the same in FIG. 5.

In these cases, the operating liquid is water and the amount of displacement of the piezoelectric element is around 4.5 μm.

Further, in FIG. 5 to FIG. 7, the solid line drawn at the interface between the region of output under 100 mW and the region of output greater than or equal to 100 mW with the one multiple mode is a line satisfying the following formula:

$$f \geq \frac{0.26}{X\sqrt{LS}}$$

Here, the inertance value of the outlet passage 2 is L(kg/m$^4$), the displacement from an upper end point to a bottom end point of the diaphragm 5 is X (m), the driving frequency is f (Hz), and the cross section area of the pump chamber is S (m$^2$).

Further, in FIG. 5 to FIG. 7, the dashed line drawn at the interface between the region of the output greater than or equal to 100 mW with a one multiple mode and the region of the output greater than or equal to 150 mW with a double multiple mode is a line satisfying the following formula:

$$f \geq \frac{0.4}{X\sqrt{LS}}$$

Here, the inertance value of the outlet passage 2 is L (kg/m$^4$), the displacement from the upper end point to the bottom end point of the diaphragm 5 is X (m), the driving frequency is f (Hz), and the cross section area of the pump chamber is S (m$^2$).

Further, in FIG. 5 to FIG. 7, the dashed line drawn at the interface between the region of the output greater than or equal to 150 mW with the double multiple mode and the region of the output greater than or equal to 100 mW with the one multiple mode and is a line satisfying the following formula:

$$f \leq \frac{0.85}{X\sqrt{LS}}$$

Here, the inertance value of the outlet passage 2 is L (kg/m$^4$), the displacement from the upper end point to the bottom end point of the diaphragm 5 is X (m), the driving frequency is f (Hz), and the cross section area of the pump chamber is S ($m^2$).

As described above, the diaphragm 5 is driven with the driving frequency f satisfying the following formula even if the size of each portion of the pump is changed so as to obtain a high output greater than 100 mW:

$$f \geq \frac{0.26}{X\sqrt{LS}}$$

Further, the diaphragm 5 is driven with the driving frequency f satisfying the following formula so as to obtain a high output greater than 150 mW with the double multiple wave mode:

$$\frac{0.85}{X\sqrt{LS}} \geq f \geq \frac{0.4}{X\sqrt{LS}}$$

When driving with the double multiple wave mode, the number of openings and closings of the check valve is half of the driving frequency. As shown in FIG. 3, the number of openings and closings of the check valve driven with the double multiple wave mode is smaller than the number of openings and closings of the check valve driven with the one multiple wave mode. In general, fatigue destruction is related to the repetition of a load so that the endurance of a check value can be improved when driven with the double multiple wave mode.

The above relationship between driving frequency and dimension can be applied not only to a sine driving wave, but to a waveform approximating a sine wave by using a low pass filter that handles a triangle wave, a saw tooth wave and a rectangle wave. The approximate sine waves in the present invention include a sine wave and a waveform approximating a sine wave. Here, in particular, it is preferable that the maximum speed of the diaphragm 5 is within ±20% when the diaphragm 5 is driven with the approximate sine wave with a given frequency, as compared to the case when it is driven by a sine wave with the same frequency If the diaphragm 5 is driven with the approximate sine wave and the sine wave, it is advantageous that a driving circuit is easily realized, the internal stress applied to a piezoelectric element is small and it is hard to destroy the element.

In the above explanation, the configuration of the diaphragm 5 is not limited to a circle. Further, the check valve 4 is not only a passive valve opened and closed by a pressure difference of a liquid, but also an active valve with controlled openings and closings by other power sources. Further, the actuator driving the diaphragm 5 may be one in which a super magnetostriction element with a high frequency is used similar to a piezoelectric element. Further, water is used as an operating fluid in the explanation, but other liquids can be used.

INDUSTRIAL APPLICABILITY

The present invention can be applied to various industries using a small pump for transferring a liquid.

What is claimed is:

1. A method of driving a pump that is provided with: a pump chamber capable of changing a volume thereof by a movable wall; an inlet passage permitting an operating fluid to flow into the pump chamber; an outlet passage permitting the operating fluid to flow out of the pump chamber; and a fluid resistance element provided on the inlet passage and the outlet passage, the method comprising:

making an innertance value of the inlet passage be smaller than the innertance value of the outlet passage; and driving the movable wall with a frequency f (Hz) satisfying the following formula:

$$f \geq \frac{0.26}{X\sqrt{LS}}$$

wherein the innertance value of the outlet passage is L ($kg/m^4$), a displacement from an upper end point to a bottom end point of the movable wall is X (m), and a cross section area of the pump chamber is S ($m^2$).

2. The method of driving a pump according to claim 1, wherein:

the movable wall is driven by the frequency f (Hz) satisfying the following formula:

$$f \geq \frac{0.4}{X\sqrt{LS}}$$

wherein the innertance value of the outlet passage is L ($kg/m^4$), the displacement from the upper end point to the bottom end point of the movable wall is X (m), and the cross section area of the pump chamber is S ($m^2$).

3. The method of driving a pump according to claim 1, wherein:

the movable wall is driven by the frequency f (Hz) satisfying the following formula:

$$f \leq \frac{0.85}{X\sqrt{LS}}$$

wherein the innertance value of the outlet passage is L ($kg/m^4$), the displacement from the upper end point to the bottom end point of the movable wall is X (m), the cross section area of the pump chamber is S ($m^2$).

4. The method of driving the pump according to claim 1, wherein the waveform of the driving is approximately a sine curve.

* * * * *

UNITED STATES PATENT AND TRADEMARK OFFICE

CERTIFICATE OF CORRECTION

PATENT NO. : 7,121,809 B2
APPLICATION NO. : 10/972974
DATED : October 17, 2006
INVENTOR(S) : Kunihiko Takagi et al.

It is certified that error appears in the above-identified patent and that said Letters Patent is hereby corrected as shown below:

Col. 8, Line 57 "curve" should be --wave--

Signed and Sealed this

Tenth Day of April, 2007

JON W. DUDAS
*Director of the United States Patent and Trademark Office*